United States Patent [19]

Graser

[11] 4,437,606

[45] Mar. 20, 1984

[54] BEVERAGE PACKAGE AND PRODUCTION BLANK WITH IMPROVED LOCKING FEATURES

[75] Inventor: Earl J. Graser, Monroe, La.

[73] Assignee: Manville Service Corp., Denver, Colo.

[21] Appl. No.: 362,213

[22] Filed: Mar. 26, 1982

[51] Int. Cl.[3] ..... B65D 5/02; B65D 71/00

[52] U.S. Cl. ..... 229/40; 206/140; 206/434

[58] Field of Search ..... 229/40; 206/140, 434

[56] References Cited

U.S. PATENT DOCUMENTS 3,270,914 6/1966 Graser ..... 229/40
3,478,951 11/1969 Graser ..... 229/40
3,548,566 12/1970 Sherman ..... 229/40
3,674,137 7/1972 Graser ..... 229/40
4,034,852 7/1977 Forrer ..... 229/40

*Primary Examiner*—Herbert F. Ross
*Attorney, Agent, or Firm*—Ronald M. Halvorsen; John D. Lister

[57] ABSTRACT

A new and improved beverage package and production blank for a beverage package having improved locking features. The novel locking feature comprises a combination of the use of primary male adjustable locking portions in combination with secondary female punch-style locking portions formed in the manner herein described. A variation of the novel combination may utilize tertiary punch-style female locking portions also formed on the margins of the locking structure.

4 Claims, 7 Drawing Figures

58
72
62
74
56
73
76
68
64
60
66
70
50
54
46
40
104
98
44
26
108
102
116
130
30
32
110
124
20
16
132
22
12
118
126
14
18
112
134
120
128
114
136
28
122
24
106
42
100
38
52
48
80
96
94
146
148
78
90
82
86
88
84
92

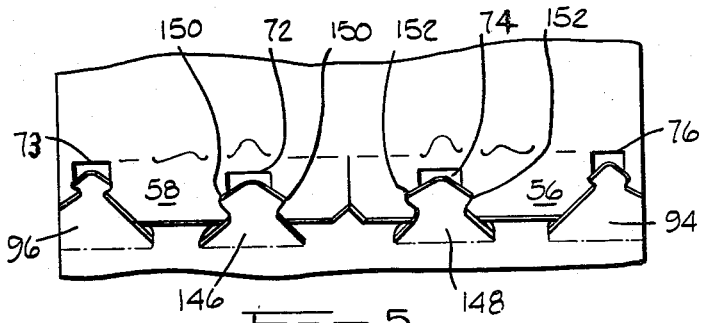
FIG. 5.
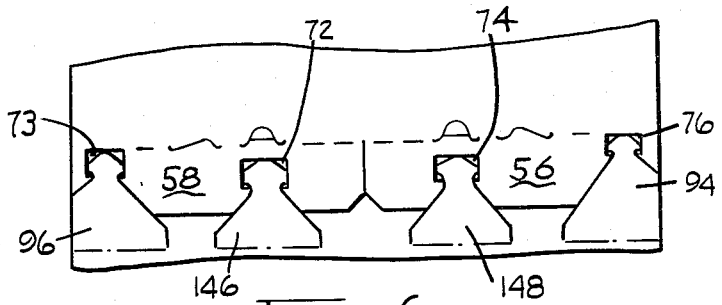
FIG. 6.
FIG. 7
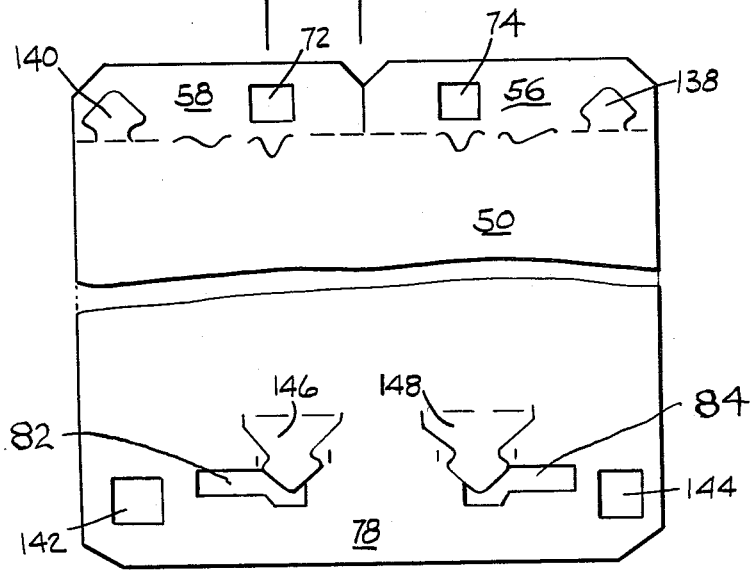

BEVERAGE PACKAGE AND PRODUCTION BLANK WITH IMPROVED LOCKING FEATURES

BACKGROUND OF THE INVENTION

This invention relates generally to beverage carriers and more particularly to a new and improved beverage package and production blank for the package having improved locking features. In the manufacture of beverage carriers, it is known to provide wrap-around style carriers having bottom locking panels for locking the carrier tightly around the bottles contained in the package. It is also known to provide adjustable locking portions in the bottom of the carriers in order to be able to tightly lock the carrier whenever an oversize or undersize group of bottles may be positioned in the carrier. Such adjustable locking features are typified in the U.S. Pat. No. 3,395,791 issued to E. J. Graser on Aug. 6, 1968; the U.S. Pat. No. 3,548,566 issued to E. C. Sherman on Dec. 22, 1970 and the U.S. Pat. No. 3,478,951 issued to E. J. Graser on Nov. 18, 1969. Such adjustable locking devices have been utilized in the past and the before-cited references are given as typical types of adjustable locking devices presently on the market, there being other forms and configurations of the locking structure presently available throughout the industry.

There is also available, automatically adjustable punch-style locking sections formed on wrap-around beverage carriers such as typified by the U.S. Pat. No. 3,508,699 issued to E. J. Graser on Apr. 28, 1970 as well as other variations of the punch-style locking portion involving changes in the configuration of the lock structure in order to accomplish positive locking.

Such known locking devices have been utilized singly to accomplish positive locking control of the package and have been satisfactory for nominal package usage as required over the years by purchasers of the package structure. In recent years, abnormal use of the package by the ultimate consumer has dictated a different locking structure combination which will give positive locking features under even the most adverse conditions in order to eliminate drop-out of the bottles from the package. For example, it has been found when the bottle carriers are dry they tend to be totally functional when carried by either two finger holes or when carried by one finger hole and on an angle. However, when the bottom of the carrier is in direct contact with water which happens in exceptional cases, a drastic reduction in the bottle retention qualities of the carrier results making the package a high risk package for bottle drop-out and possible injury to the ultimate customer of the package.

It has also been found that if the package is exposed to a cold environment such as might occur in a cold box at a retail outlet of say 40° F., and the package is purchased and placed in a hot, humid environment such as a consumer's car trunk for two or three hours, the carrier also may become a high risk one for bottle fall-out during carrying of the package by the consumer. The probable reason for this is that it is felt condensation forming on the cold package, running down the bottles' sides and soaking the bottom carrier panel can contribute to reduced retention qualities of the carrier locking portions.

It is also felt that bottle fall-out can result in carriers when the carrier loses "rigidity" as a result of controlled environmental warehousing, hot, humid conditions in delivery trucks and cold boxes at retail outlets. When subject to the above, it is felt that condensation may form on the cold bottles and transfer to the carrier board to possibly weaken the carrier considerably in the area of the locking portions. When such conditions occur, it is felt that the carrier may become a high risk package even though these adverse conditions appear to occur at exceptional times only and not normal times during the life cycle of the package.

SUMMARY OF THE INVENTION

In order to overcome the before-mentioned problems that may occur in exceptional conditions to which a beverage package may be subjected, there has been provided by the subject invention a new and novel beverage package and production blank for a beverage package having improved locking features. These improved features combine the positive locking features of the before-described primary male and female adjustable locking sections incorporated in prior art devices with secondary punch-style locking portions also incorporated in other devices. When combined thusly, the new and improved package has improved qualities which should be able to withstand the exceptional conditions hereinbefore described. There is also featured with the Applicant's new and improved beverage package a tertiary male and female locking portion which may be added to the before-mentioned combination in order to provide a still more positive locking section heretofore unobtainable in known packages.

Accordingly, it is an object and advantage of the invention to provide a new and improved beverage package which may be used on a wrap-around style package and on other type packages which combines primary male and female adjustable locking portions with secondary punch-style male and female locking portions in a manner more fully described hereinafter.

Another object and advantage of the invention is to provide a new and improved locking portion for a beverage package and production blank which utilizes a new combination of locking sections along with a tertiary locking section to provide a still further improved locking structure.

These and other object and advantages of the invention will become apparent from a review of the drawings and from a study of the Description of the Preferred Embodiment which has been given by way of illustration only.

BRIEF DESCRIPTION OF THE DRAWINGS

FIG. 5 is a bottom view showing the positioning of the first or outer margin of the package and showing the secondary and tertiary punch-style male locking portions about to be engaged with the secondary and tertiary female locking portions formed on the first margin;

FIG. 6 is a bottom view of the package as seen in FIG. 5 showing the secondary and tertiary punch-style male locking portions engaged in the secondary and tertiary female punch-style locking portions formed on the first or outer margin of the package; and FIG. 7 is a partial plan view of the locking portions of a modification of the production blank shown in FIG. 2 showing a modification in the tertiary locking section of the locking portions.

DESCRIPTION OF THE PREFERRED EMBODIMENT

Figure 1:
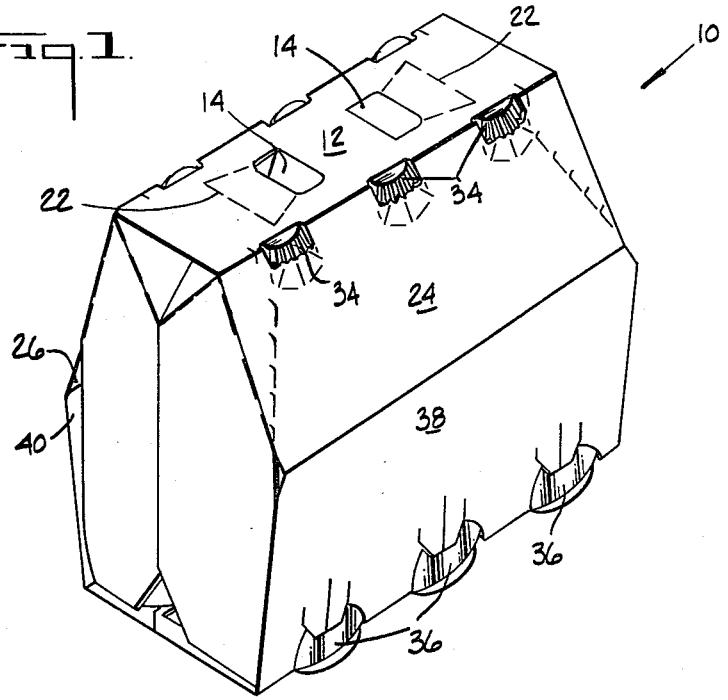
FIG. 1 is a perspective view of a typical wrap-around style beverage package having bottom locking portions of the type herein covered by the Applicant's invention.
Figure 2:
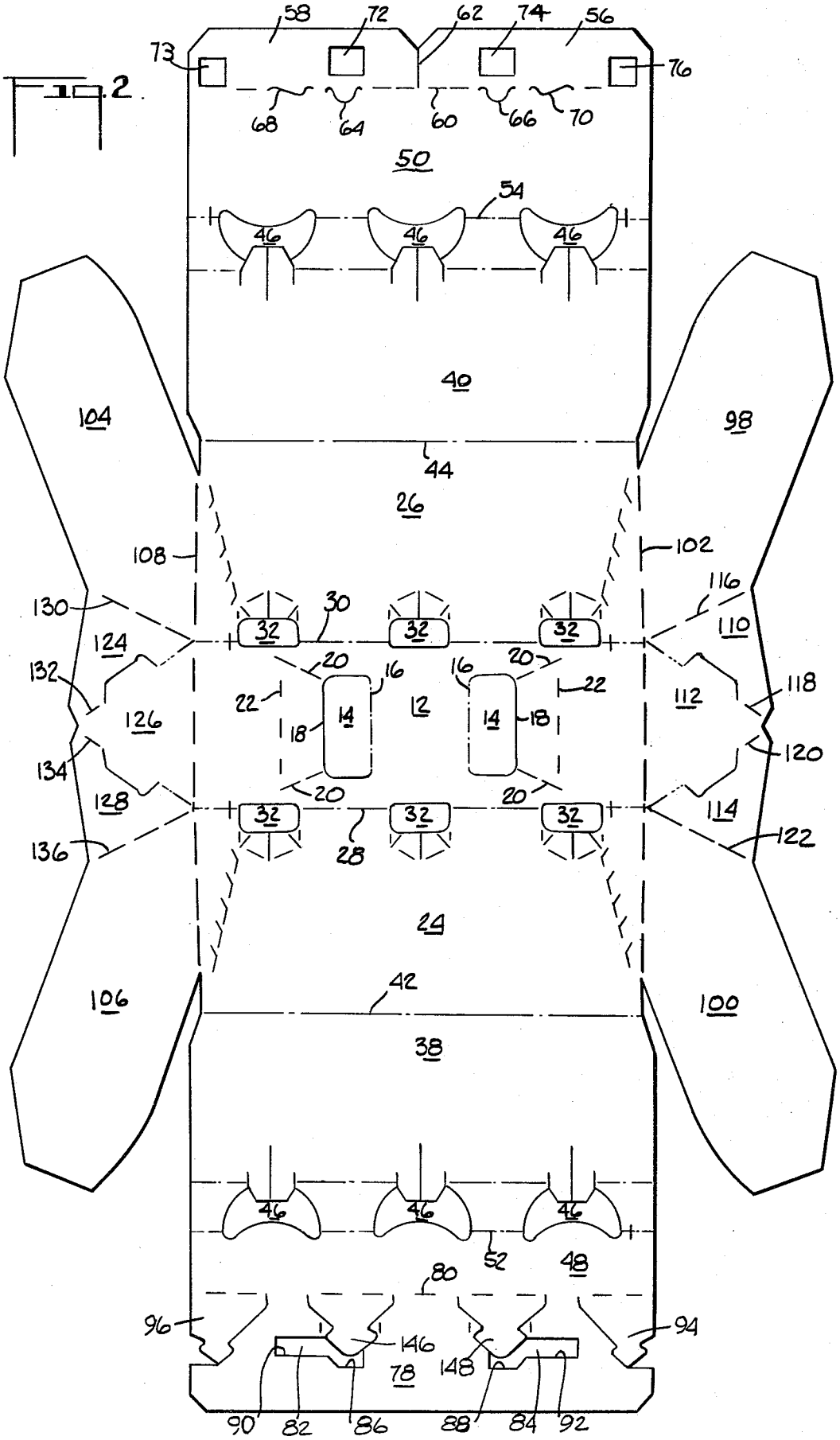
FIG. 2 is a plan view of one style of production blank for utilizing the Applicant's novel combination of locking portions hereinbefore described.

Referring now to the drawings in general and in particular to FIGS. 1 and 2 of the drawings, there is shown in FIG. 1, generally by the numeral 10, the Applicant's improved beverage package formed as a wrap-around style beverage carrier. The carrier has a centrally positioned top panel 12 having formed thereon handle means 14. The handle means 14 are formed as a pair of handle tabs hingedly attached by means of the score lines 16 and the die cuts 18. The top panel 12 may also have an easy-open feature formed by means of the score lines 20 and the pair of score lines 22.

A pair of sloping side panels 24 and 26 are hingedly attached to opposite sides of the top panel 12 by means of the score lines 28 and 30. Each sloping side panel 24 and 26 has formed thereon a plurality of bottle neck receiving openings 32 for receiving the caps 34 of bottles 36 contained within the package.

A pair of vertical side panels 38 and 40 are hingedly attached to each side of the sloping side panels 24 and 26 by means of the score lines 42 and 44. The vertical side panels 38 and 40 have formed therein a plurality of bottle bottom receiving openings 46 for receiving the bottoms of the bottles 36 contained within the package.

A pair of bottom panels 48 and 50 are hingedly attached to each vertical side panel 38 and 40 by means of the score lines 52 and 54. A first outer margin 56 and 58 is hingedly attached to one of the bottom panels by means of the score line 60 as shown in FIG. 2 of the drawing. The first outer margin 56 and 58 is formed as a split margin by means of the die cut 62 as is known in the art. The first outer margin 56 and 58 has formed thereon primary male adjustable locking portions in the form of oversized tabs 64 and 66 as well as undersized tabs 68 and 70. The first outer margin 56 and 58 also has formed thereon secondary female punch-style locking portions in the form of a generally rectangular shaped secondary female opening 72 and 74.

In the preferred embodiment, the first outer margin 56 and 58 may also have formed thereon tertiary punch-style female locking portions 73 and 76 in the form of a generally rectangular shaped opening positioned as shown in FIG. 2 of the drawing.

On the opposite side of the production blank, there is formed a second or inner margin 78 hingedly attached to the bottom panel 48 by means of the score line 80. The second inner margin 78 has formed thereon primary female locking portions in the form of an irregular shaped slot 82 and 84. The irregular slots 82 and 84 have formed thereon an oversized position edge 86 and 88 and an undersized position edge 90 and 92. The oversized edge 86 and 88 and the undersized edge 90 and 92 are positioned to be engagable with the oversized tab 64 and 66 formed on the first margin 56 and 58 as well as the undersized tab 68 and 70 formed on the first margin.

A plurality of secondary punch style male locking tabs 146 and 148 are formed on the second inner margin 78 and are hinged thereto from the score line 80.

The second inner margin 78 may also have formed thereon a tertiary punch-style male locking portion 146 and 148 in the form of a pair of punch-style male locking tabs 94 and 96 positioned as shown in FIG. 2 on each side of the primary female locking portions and secondary punch-style male locking portions. The production blank shown in FIG. 2 may also be formed with a pair of end panels 98 and 100 formed on one side of the package by means of the score line 102 and a plurality of end panels 104 and 106 formed on the other side of the package by means of the score line 108. Completing the ends of the package there may also be formed thereon a plurality of triangular panels 110, 112 and 114 formed on one side of the package by means of the score lines 116, 118, 120 and 122. On the other side of the package there may be formed thereon a plurality of triangular panels 124, 126 and 128 formed by means of the score lines 130, 132, 134 and 136.

Referring now to FIG. 7 of the drawing, there is shown a partial plan of a variation of the production blank locking portion shown in FIG. 2 showing a variation in the positioning of the tertiary locking portions of the invention should these portions be utilized in the preferred embodiment. It can be seen in FIG. 7 that the first outer margins 56 and 58 have formed thereon a pair of punch-style tertiary male locking tabs 138 and 140 formed on each side of the secondary opening 72 and 74. In a similar manner, the second inner margin 78 has formed thereon a pair of tertiary female locking portions in the form of a pair of rectangular shaped openings 142 and 144 positioned as shown in FIG. 7 on each side of the primary female locking portions 82 and 84 and the secondary punch-style male locking portions 146 and 148. The remainder of the production blank configuration of the variation shown in FIG. 7 would be formed similar to that portion of the production blank shown in FIG. 2 of the drawing between the first and second margins.

Figure 3:
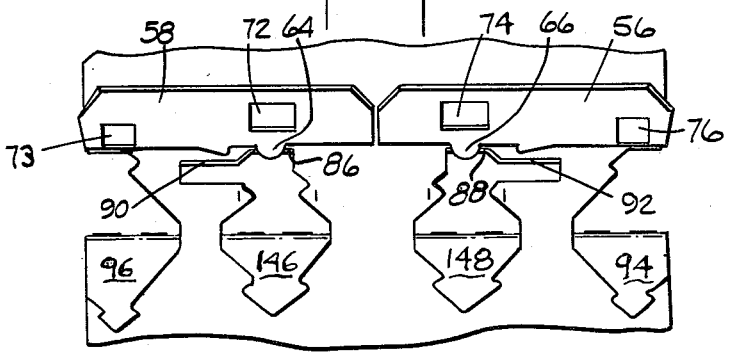
FIG. 3 is a bottom view of the package shown in FIG. 1, showing the oversize tab of the Applicant's primary male adjustable locking portion being locked whenever an oversize of bottles is sensed in the package when the package is being run through a packaging machine.
Figure 4:
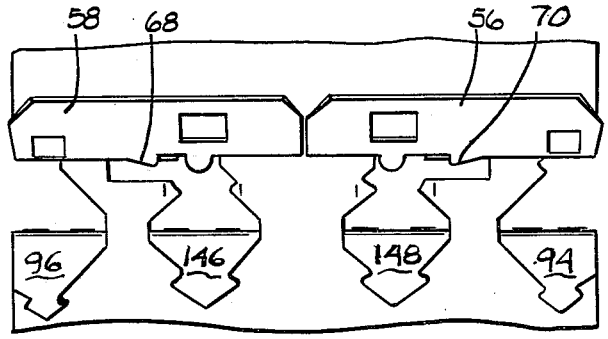
FIG. 4 is a bottom view of the package shown in FIG. 1, showing the undersize tab of the primary male adjustable locking portion being locked whenever an undersize condition of the bottles is detected by the packaging machine through which the package would be run.

Referring now to FIGS. 3 to 6 of the drawing, there can be seen the locking sequence of the Applicant's new and novel lock combination showing how the oversized tabs 64 and 66 would engage the oversized position edge 84 and 86 whenever an oversized group of bottles was sensed in the package by the packaging machine through which the package is run. This condition is shown in FIG. 3 of the drawings and the undersized condition is shown in FIG. 4 of the drawings where it can be seen that the undersized tabs 68 and 70 would then engage the undersize position edge 90 and 92 to lock the primary male adjustable locking portion of the Applicant's device.

Thereafter, the secondary punch-style male locking portion of the Applicant's combination would be engaged as shown in FIG. 5 whereupon the secondary punch-style male locking tabs 146 and 148 would be engaged in the secondary female punch-style locking openings 72 and 74 positioned on the first outer margins 56 and 58. The final position of the male punch-style locking tabs 146 and 148 is as shown in FIG. 6 of the rawing with the side edges 150 and 152 being positioned beneath the first margins 56 and 58 in the manner shown in FIG. 6.

Should it be desirable to use the tertiary locking feature of the Applicant's combination then the tertiary male locking tabs 94 and 96 would be engaged in the tertiary female openings 76 and 73 and would be engaged underneath the first margin 56 and 58 as seen also in FIG. 6.

From the foregoing, it can be seen that there has been provided by the subject invention a new and improved beverage package and production blank for a beverage package which may be used on a wrap-around style carrier and on other types of carriers with the novel feature comprising a combination of primary male and female adjustable locking portions and secondary male and female punch-style locking portions. This combination may also be utilized with a tertiary punch-style male and female locking portion formed on the margins of the package in order to obtain the desired degree of freedom from lock separation due to the various beforementioned extraordinary conditions encountered in the package in the field. It should also become apparent from a review of the drawings that features of the combination may be varied and changes made in the various configuration of the locking structure and arrangement of the locking portions and the locking structure as well as other changes to the package without departing from the spirit and scope of the invention which shown in the preferred embodiment by way of illustration only.

Having described my invention, I claim:

1. A wrap-around style beverage package for a plurality of cans or bottles of beverage, the package surrounding the cans or bottles and having locking means on overlapping first and second margins of the package, comprising:

(a) the first margin having a primary male adjustable locking portion comprising two oversized position tabs and two undersized position tabs; and (i) the second margin having primary female adjustable locking portions engaged by the primary male adjustable locking portions of the first margin and comprising two oversized position slots positioned for engagement with the oversized position tabs on the first margin and two undersized position slots positioned for engagement with the undersized position tabs of the first margin;

(b) the second margin having secondary punch-style arrow-shaped male locking tabs; and (i) the first margin having secondary punch-style, female locking openings engaged by the secondary punch-style male locking tabs; and;

(c) the first margin having tertiary punch-style, arrow-shaped male locking tabs on each side of the primary male adjustable locking portion; and (i) the second margin having tertiary punch-style female locking openings on each side of the primary female adjustable locking portions engaged by the tertiary punch-style male locking tabs.

2. The beverage package as defined in claim 1 further comprising the package being formed as a wrap-around style package and further comprising a plurality of end panels being hingedly attached to a portion of the package to enclose the ends of the package.

3. A production blank for a wrap-around style beverage carrier, comprising:

(a) a centrally positioned top panel having formed thereon handle means;

(b) a pair of sloping side panels hingedly attached to opposite sides of the top panel, each side panel having formed therein a plurality of bottle neck receiving openings;

(c) a pair of vertical side panels hingedly attached to each side of the sloping side panels, each vertical side panel having formed therein a plurality of bottle bottom receiving openings;

(d) a pair of bottom panels hingedly attached to each vertical side panel; and (e) a first outer margin hingedly attached to one of the bottom panels and a second outer margin hingedly attached to the other bottom panel;

(f) the first margin having a primary male adjustable locking portion comprising two oversized position tabs and two undersized position tabs; and (i) the second margin having primary female adjustable locking portions positioned for engagement by the primary male adjustable locking portions of the first margin and comprising two oversized position slots positioned for engagement with the oversized position tabs on the first margin and two undersized position slots positioned for engagement with the undersized position tabs of the first margin;

(g) the second margin having secondary punch-style arrow-shaped male locking tabs; and (i) the first margin having secondary punch-style female locking openings positioned for engagement by the secondary punch-style male locking tabs; and (h) the first margin having tertiary punch-style, arrow-shaped male locking tabs on each side of the primary male adjustable locking portion; and (i) the second margin having tertiary punch-style female locking openings on each side of the primary female adjustable locking portions for engagement by the tertiary punch-style male locking tabs.

4. The production blank as defined in claim 3 further comprising a pair of end panels being formed on opposite sides of the sloping side panels and the top panel for enclosing the ends of the package whenever the production blank is erected into a package.

* * * * *